US008807167B2

(12) United States Patent
Song

(10) Patent No.: US 8,807,167 B2
(45) Date of Patent: Aug. 19, 2014

(54) DIGITAL FLUID CONTROL VALVE

(75) Inventor: Su Yong Song, Buena Park, CA (US)

(73) Assignee: Muirsis Incorporated, Brea, CA (US)

( * ) Notice: Subject to any disclaimer, the term of this patent is extended or adjusted under 35 U.S.C. 154(b) by 274 days.

(21) Appl. No.: 13/444,741

(22) Filed: Apr. 11, 2012

(65) Prior Publication Data

US 2013/0269786 A1 Oct. 17, 2013

(51) Int. Cl.
*F16K 11/16* (2006.01)

(52) U.S. Cl.
USPC ..... 137/607; 137/599.04; 137/599.07; 251/129.04

(58) Field of Classification Search
CPC .... F16K 19/006; B01F 15/0412; E03C 1/057
USPC ..... 137/599.04, 599.07, 606, 607; 251/129.04
See application file for complete search history.

(56) References Cited

U.S. PATENT DOCUMENTS

| | | | | |
|---|---|---|---|---|
| 3,081,942 | A * | 3/1963 | Maclay | 341/151 |
| 3,886,971 | A * | 6/1975 | Lundsgaard et al. | 137/599.04 |
| 3,905,394 | A * | 9/1975 | Jerde | 137/599.04 |
| 4,915,123 | A * | 4/1990 | Morgovsky et al. | 137/599.04 |
| 5,090,780 | A | 2/1992 | Powell | |
| 6,513,787 | B1 * | 2/2003 | Jeromson et al. | 251/129.04 |
| 2007/0252012 | A1 | 11/2007 | Gardner et al. | |

* cited by examiner

*Primary Examiner* — John K Fristoe, Jr.
*Assistant Examiner* — Reinaldo Sanchez-Medina
(74) *Attorney, Agent, or Firm* — Seyfarth Shaw LLP

(57) ABSTRACT

A method for regulating water output is presented. The method includes receiving an input at a plurality of sensors, transmitting a signal to a control unit in response to receiving the input, controlling, via the control unit, a first plurality of solenoid valves to regulate hot water controlling, via the control unit, a second plurality of solenoid valves to regulate cold water in response to the signal, creating a water mixture comprising at least hot water output from at least one of the first plurality of solenoid valves or cold water output from at least one of the second plurality of solenoid valves, and outputting the water mixture to a water output unit.

18 Claims, 5 Drawing Sheets

DIGITAL FLUID CONTROL VALVE

BACKGROUND

1. Field

The present disclosure is related, generally, to a digital fluid control valve, and more specifically, to a digital fluid control valve that regulates a volume and/or temperature of water that is output from a plumbing fixture.

2. Background

A typical water dispenser system, such as a faucet or shower may require a user to adjust a water output level for hot water and cold water via knobs or levers. Furthermore, typical water dispenser systems may also rely on at least one cartridge defined within the system to control the volume of hot water and cold water dispensed via a faucet. Specifically, the typical system uses a cartridge system to deliver the hot water and cold water in a linear motion. For example, a user may request for an increase in water flow while a faucet is dispensing a small amount of water. In this example, the typical cartridge system would cycle through various iterations to reach the appropriate flow setting. Accordingly, the use of a cartridge system increases the time required to reach the desired water flow.

Additionally, over time, knobs and levers may become loose and worn out. Furthermore, the cartridge may also wear out and replacement may be necessary. Accordingly, a typical water dispenser system may not accurately deliver hot water or cold water when the knobs, levers, or cartridges wear out.

Thus, it is desired to provide a solution that does not utilize a cartridge to deliver the hot water and the cold water. Provided is an aspect that utilizes a digital fluid control valve with solenoid valves to accurately deliver the amount of hot water and cold water as requested by the user.

SUMMARY

According to an aspect, a method for regulating water output is presented. The method includes receiving an input at a plurality of sensors, transmitting a signal to a control unit in response to receiving the input, controlling, via the control unit, a first plurality of solenoid valves to regulate hot water controlling, via the control unit, a second plurality of solenoid valves to regulate cold water in response to the signal, creating a water mixture comprising at least hot water output from at least one of the first plurality of solenoid valves or cold water output from at least one of the second plurality of solenoid valves, and outputting the water mixture to a water output unit.

According to one feature, the first plurality of solenoid valves and the second plurality of solenoid valves are attached to a mixing chamber. Furthermore, controlling the first plurality of solenoid valves comprises opening or closing each of the first plurality of solenoid valves to regulate a hot water volume in the mixing chamber, and controlling the second plurality of solenoid valves comprises opening or closing each of the first plurality of solenoid valves to regulate a cold water volume in the mixing chamber. Moreover, controlling the first plurality of solenoid valves comprises opening or closing each of the first plurality of solenoid valves according to a size of a hot water opening associated with each of the first plurality of solenoid valves, controlling the second plurality of solenoid valves comprises opening or closing each of the first plurality of solenoid valves according to a size of a cold water opening associated with each of the second plurality of solenoid valves.

According to another feature, transmitting the signal comprises transmitting a first signal for increasing a water temperature, a second signal for decreasing the water temperature, a third signal for increasing a water pressure, and a fourth signal for decreasing the water pressure.

According to yet another feature, the method further includes receiving the hot water at the first plurality of solenoid valves via a hot water input unit, and receiving the cold water at the second plurality of solenoid valves via water input unit.

According to still yet another feature, the plurality of sensors are infra-red touch free sensors. Furthermore, the water output unit is a faucet.

According to another aspect, a water regulating apparatus is presented. The apparatus includes an input unit configured to receive a user input via a plurality of sensors, a control unit configured to transmit a signal in response to the user input, and a control box including a first plurality of solenoid valves to regulate hot water, a second plurality of solenoid valves to regulate cold water, the control box configured to control at least the first plurality of solenoid valves or second plurality of solenoid valves to create a water mixture comprising at least hot water output from at least one of the first plurality of solenoid valves or cold water output from at least one of the second plurality of solenoid valves in response to the transmitted signal, and output the water mixture to a water output unit.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION

A solenoid valve may refer to an electromechanical valve for use with liquid or gas. The solenoid valve may be controlled by an electrical current. For example, in a two-port solenoid valve, the flow may be switched on or off. A series of solenoid valves may be defined over a series of fluid control valve openings to form a fluid valve system. The fluid valve system may control the amount of hot water or cold water that may flow into a digital fluid control valve body. The digital fluid control valve body will be referred to as a mixing chamber. The water mixture from the mixing chamber may be dispensed from an output device, such as a faucet or shower head. The amount of hot water and cold water may be computer controlled to deliver the requested amount of water via a non-linear system.

Figure 1:
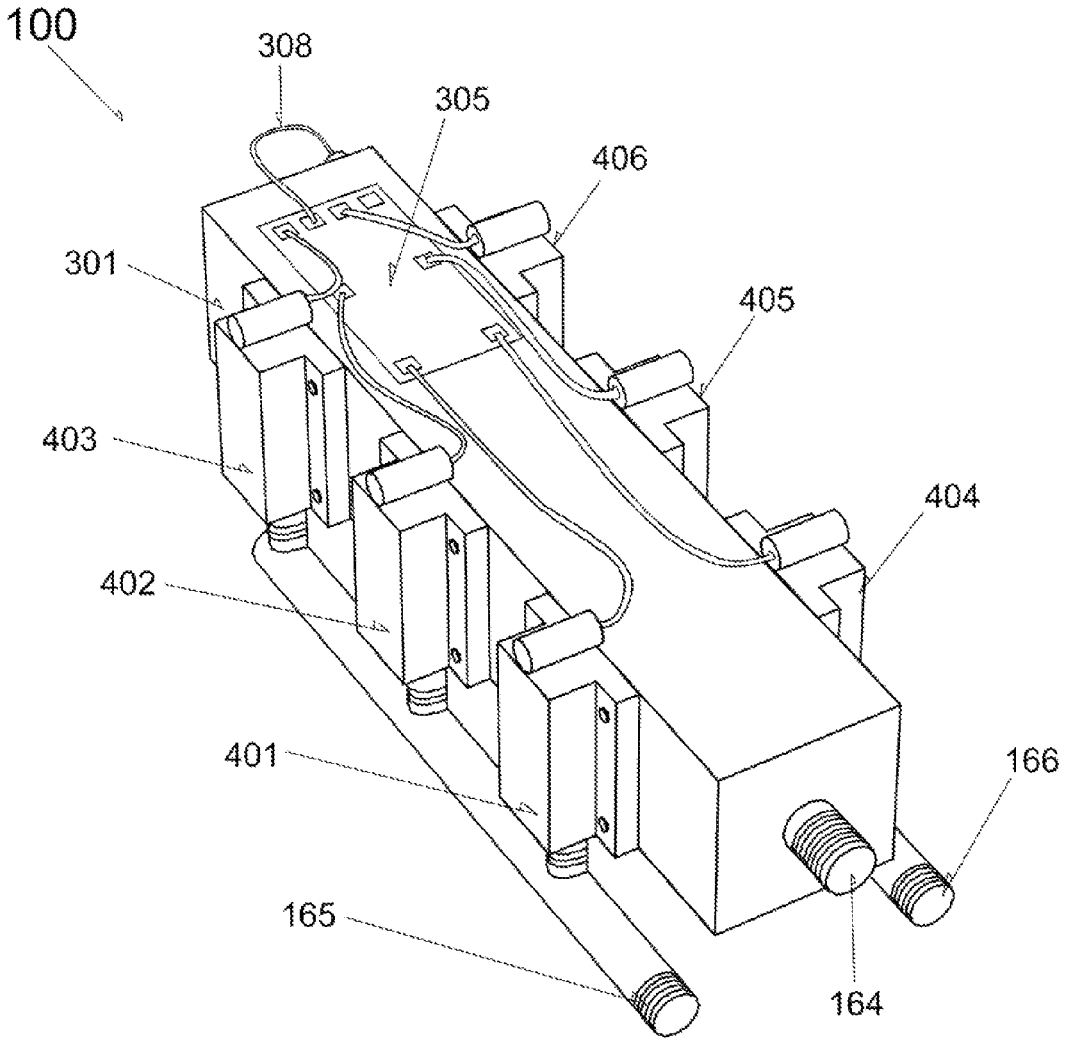
FIG. 1 illustrates an example of a fluid control valve according to an aspect of the present disclosure.

FIG. 1 illustrates a fluid valve system according to an aspect of the present disclosure. The fluid valve system 100 may include a mixing chamber 301 including at least a pair of solenoid valves. For example, as illustrated in FIG. 1, a first, second, and third hot water solenoid valves 401-403 may be defined on a first side of the mixing chamber 301 and a first, second, and third cold water solenoid valves 404-406 may be defined on a second side of the mixing chamber 301. In this example, the second side is opposite the first side.

The first, second, and third hot water solenoid valves 401-403 may be connected to a hot water intake pipe 165 to receive a hot water input. Likewise, the first, second, and third cold water solenoid valves 404-406 may be connected to a cold water intake pipe 166 to receive a cold water input. A water outlet 164 may be defined within the mixing chamber 301 to output water from the mixing chamber 301.

Furthermore, as illustrated in FIG. 1, the mixing chamber 301 may include a thermocouple 308 to determine the temperature of the water in the mixing chamber 301. A control board 305 may also be defined on the mixing chamber 301. The control board 305 may be connected to the thermocouple 308 to obtain the measured temperature and may also be connected to each solenoid valve to independently control each solenoid valve.

Figure 2:
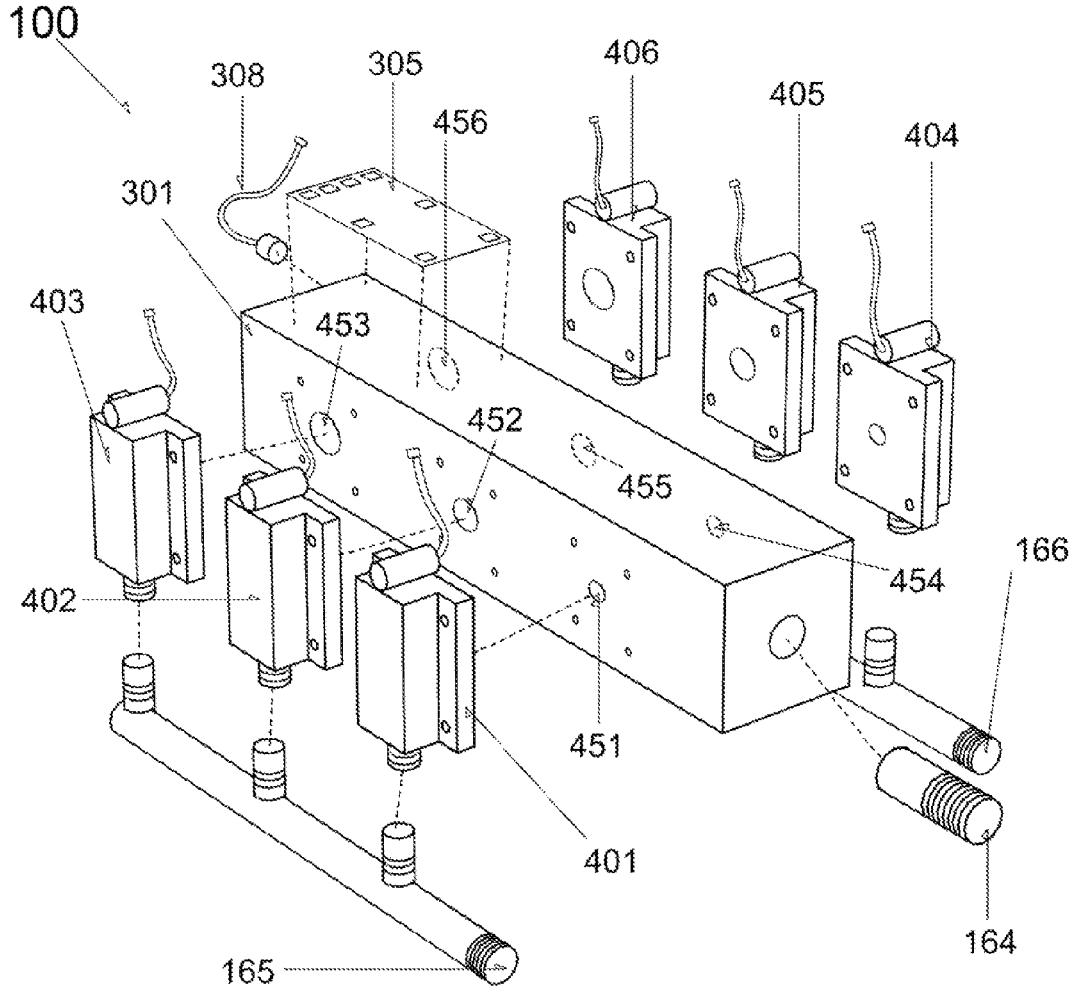
FIG. 2 illustrates an example of an exploded view of the fluid control valve of FIG. 1 according to an aspect of the present disclosure.

FIG. 2 illustrates a fluid valve system according to an aspect of the present disclosure. The fluid valve system 100 of FIG. 2 is an exploded view of the fluid valve system of FIG. 1.

In one aspect, a number of openings may be defined within the mixing chamber 301 to allow water to enter the mixing chamber 301. Specifically, each opening may be associated with one of the solenoid valves defined on the mixing chamber 301. Moreover, according to the current aspect the openings may vary in size. Still according to another aspect, all or some of the openings may have the same size.

For example, as illustrated in FIG. 2, a number of openings may be defined on one side of the mixing chamber 301 to correspond with the first, second, and third hot water solenoid valves 401-403. Specifically, a first hot water opening 451 may correspond with first hot water solenoid valve 401. More specifically, the first hot water opening 451 may be smaller in comparison to the other hot water openings, and therefore, less water may enter the mixing chamber 301 via the first hot water opening 451 in comparison to the amount of water that may enter the mixing chamber 301 via other openings.

Furthermore, a second hot water opening 452 may correspond with the second hot water solenoid valve 402 and may be larger than the first hot water opening 451. In other words, the second hot water opening 452 may have a size that is a specific multiple of the size of the first hot water opening 451. For example, the second hot water opening 452 may be twice the size of the first hot water opening 451.

Moreover, a third hot water opening 453 may correspond with the third hot water solenoid valve 403 and may be larger than the second hot water opening 452. In other words, the third hot water opening 453 may be a size that is a specific multiple of the size of the second hot water opening 452. For example, the third hot water opening 453 may be twice the size of the second hot water opening 452.

Additionally, as illustrated in FIG. 2, a number of openings may be defined on another side of the mixing chamber 301 to correspond with the first, second, and third cold water solenoid valves 404, 405, and 406.

Specifically, a first cold water opening 454 may correspond with the first cold water solenoid valve 404. More specifically, the first cold water opening 454 may be smaller in comparison to the other cold water openings, and therefore, less water may enter the mixing chamber 301 via the first cold water opening 454 in comparison to the amount of water that may enter the mixing chamber 301 via other openings.

Furthermore, a second cold water opening 455 may correspond with the second cold water solenoid valve 405 and may be larger than the first cold water opening 454. In other words, the second cold water opening 455 may have a size that is a specific multiple of the size of the first cold water opening 454. For example, the second cold water opening 455 may be twice the size of the first cold water opening 454.

Moreover, a third cold water opening 456 may correspond with the third cold water solenoid valve 406 and may be a size that is larger than the second cold water opening 455. In other words, the third cold water opening 456 may have a size that is a specific multiple of the size of the second cold water opening 455. For example, the third cold water opening 456 may be twice the size of the second cold water opening 455.

It should be noted that aspects of the disclosure are not limited to the three hot water solenoid valves, three cold water solenoid valves, and the openings associated with each valve. The number of hot water and cold water solenoid valves may be adjusted as desired. Moreover, the number of openings may be adjusted to correspond to the number of hot water and cold water solenoid valves. An increased number of solenoid valves and associated openings may provide the user with an increased number of temperature and water flow settings. Additionally, the order for the size of the openings is not limited to the small to large ordering of the present disclosure, other orderings, such as large to small or a random ordering may be utilized as desired.

In one aspect, the hot water and cold water solenoid valves may be associated with a binary string. For example, as illustrated in FIGS. 1 and 2, the fluid control valve system 100 may include three hot water solenoid valves, and therefore, in this example, the three hot water solenoid valves would be associated with a three digit binary number. According to one aspect, the first hot water opening 451 may be associated with the first binary number in the binary string. Alternatively, according to another aspect, the first hot water opening 451 may be associated with the final binary number in the binary string. The remaining openings may be associated with digits in the binary string in accordance with the association of the first hot water opening with a digit in the binary string.

In this aspect, a binary numerical value of 0 may represent a closed solenoid valve such that water does not flowing through the opening. Additionally, a binary numerical value of 1 may represent an open solenoid valve such that the water flows through the opening. Alternatively, according to another aspect, a binary numerical value of 1 may represent a closed solenoid valve such that water does not flowing through the opening. Additionally, a binary numerical value of 0 may represent an open solenoid valve such that the water flows through the opening.

For example, in a fluid control valve system with three hot water solenoid valves, an input of "000" will cause the three hot water solenoid valves to be closed. In this example, the input of "000" may be received when there is a user input for no hot water.

As another example, an input of "001" may open either the first hot water solenoid or the third hot water solenoid depending on the configuration of the fluid control valve system. As yet another example, an input of "010" may open the second hot water solenoid valve.

In this aspect, the fluid control valve system may receive the binary input in response to a user's request for a specific hot water temperature. Specifically, the binary input controls the number of solenoid valves that may be opened, and therefore, the flow of hot water into the fluid control valve may be controlled.

Accordingly, the cold water solenoid valves may be opened and closed according to a binary string input that is similar to the aspects and examples disclosed with regard to the hot water solenoid valves.

According to one aspect, the fluid control valve system may utilize infra-red touch free sensors to facilitate activating and de-activating an output device, such as a the faucet. Additionally, the infra-red touch free sensors may adjusts the hot water or cold water settings. The infra-red touch free sensors may perform the aforementioned functions via one step or a plurality of steps. Accordingly, infra-red touch free sensors provide an ancillary benefit because a user may not be required to physically touch any knobs or levers on the faucet.

According to an aspect, the user may input a command via the infra-red touch free sensors. The command may be transmitted to a sensor control board that may then provide the command to a control module for controlling the solenoid valves. The control module may open and close specific solenoid valves to produce the water temperature requested by the user via the input received at the infra-red touch free sensors.

As discussed with regard to FIGS. 1 and 2, the solenoid valves regulate the amount of hot water and cold water that may enter the mixing chamber of the fluid control valve system. The water is mixed in the mixing chamber via the force of the water entering the chamber. However, the mixing chamber may include hardware to mix the hot and cold water if desired. When the desired temperature has been achieved, the water mixture may be released via an output pipe defined on the mixing chamber. This output pipe may be connected to an output device, such as a faucet via a hose. The water may then be discharged from the output device.

As the user adjusts the water temperature or water flow, the control module may control each of the solenoid valves to dispense the desired amount of hot and cold water. In other words, each of the solenoid valves open and close according to a specific user request and each solenoid valve may deliver a specific amount of hot water or cold water depending on the size of the opening corresponding to each solenoid valve. The actions of the fluid control valve system are computer controlled for accuracy.

For example, a user may first request a medium flow of cold water via the infra-red touch sensor. In response to the user input, the control module controls specific cold water solenoid valves to reach the requested water flow and water temperature. In this example, the control module may open additional cold water solenoid valves or close specific solenoid valves if the user requests for a change in water flow or water temperature. For example, while the faucet is outputting the requested amount of cold water, the user may request to change the output to a strong flow of hot water. Thus, the control module controls specific cold water and hot water solenoid valves to be closed or opened to reach the desired temperature and flow. The resulting change in water temperature and flow is non-linear because the control module may open and close solenoid valves associated with various openings that differ in size.

Figure 3:
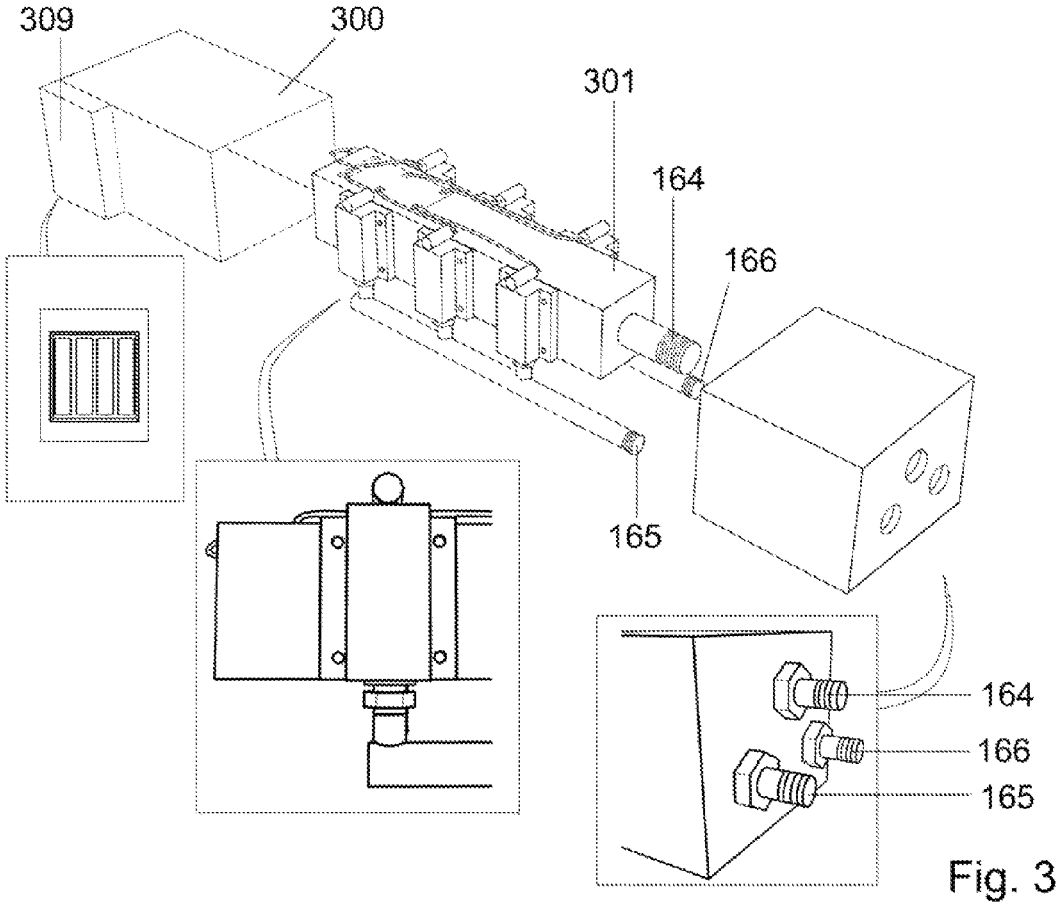
FIG. 3 illustrates an example of a housing for the fluid control valve according to an aspect of the present disclosure.

According to an aspect, the mixing chamber may be encased in a control box to protect the mixing chamber from various elements, such as debris or water. FIG. 3 illustrates an example of a control box.

As illustrated in FIG. 3, a the mixing chamber 301 may be disposed within the control box 300. Various openings may be defined within the control box 300 to allow for the cold water intake pipe 166, hot water intake pipe 165, and water outlet 164 to be connected to various hoses or connections. Furthermore, a battery box 309 may be defined on the control box 300 to provide back up power to the mixing chamber. The position of the battery box 309 is not limited to the position illustrated in FIG. 3.

Figure 4:
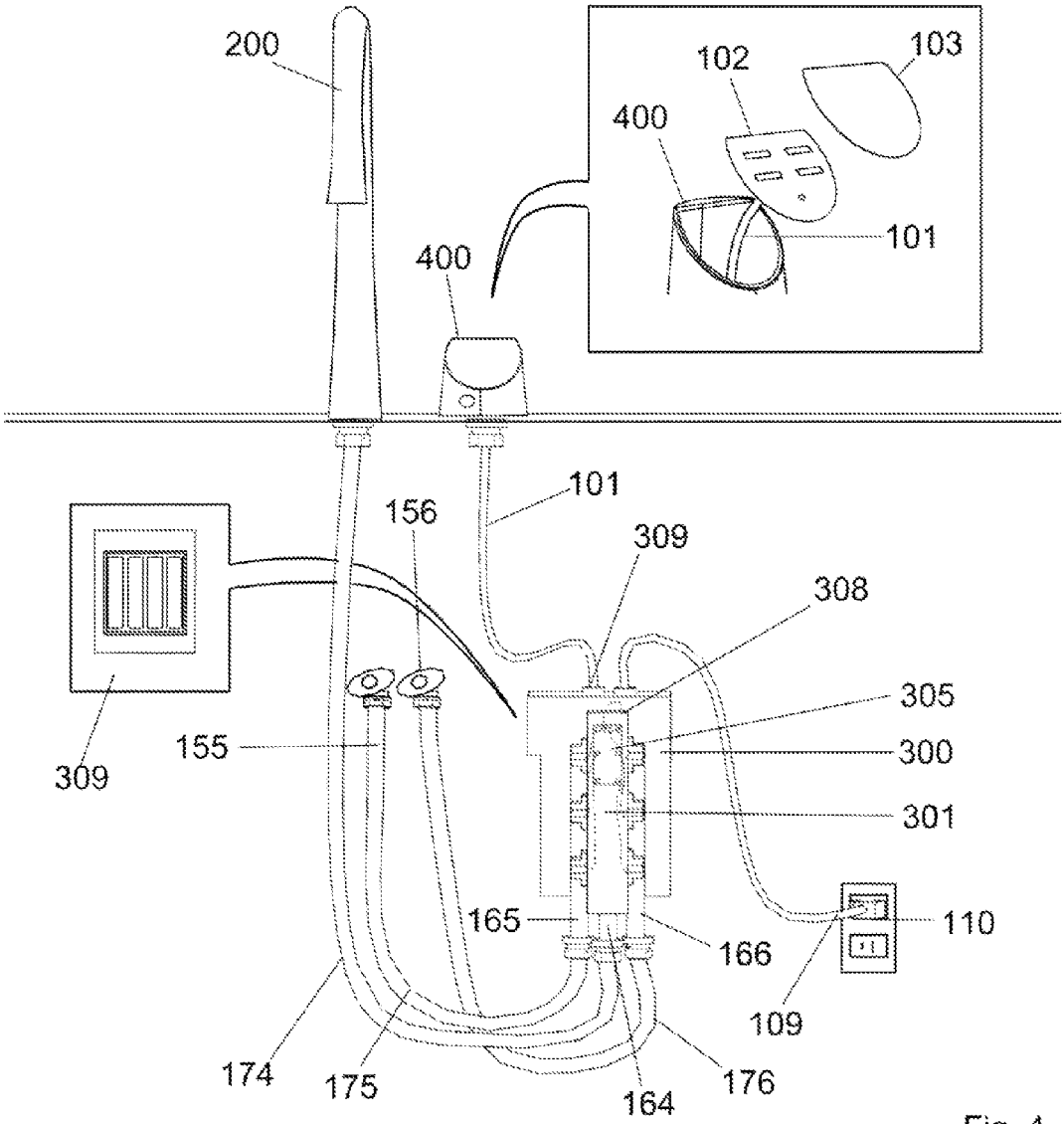
FIG. 4 illustrates an example of a fluid control valve system according to an aspect of the present disclosure.

According to an aspect, the fluid control valve system may include a water output device, such as a faucet, and a user input device, such as an infra-red touch free sensor. The infra-red touch free sensor may receive a user input with regard to at least a desired water temperature or a water flow, and the fluid control valve may adjust the water temperature according to the user input. FIG. 4 illustrates an example of the fluid control valve system.

As illustrated in FIG. 4, as an example, a single control panel 400 may be disposed adjacent to a faucet 200. The control panel may be enclosed in a waterproof housing that is made from a waterproof material such as plastic, brass, aluminum, or other material. The control panel 400 may house a sensor control board 102. A transparent surface 103 may defined over the sensor control board 102 to allow passage of the infra-red light. The transparent surface may be scratch resistant and made of a transparent or semi-transparent material such as glass or acrylic. The sensor board 102 may be connected to the control box 300 or directly to the control board 305 via a controller cable 101.

The control panel 400 and control board 102 may be incorporated on their own or together, and may be combined in whole or in part with those discussed in co-owned Provisional Patent Application No. 61/609,152, filed Mar. 9, 2012 in the names of Bedolla et al., The fluid control valve adjusts the water temperature in response to an input received via the sensor board 102. The water mixture may be distributed to the faucet 200 via a water supply hose 174 that may be connected to the water outlet 164 when the desired temperature has been achieved. One end of the water supply hose 174 may be connected to the faucet 200.

The mixing chamber 301 may include a thermocouple 308 to record the temperature of the water. The recorded water temperature may be received by the control board 305 and transmitted to the sensor board 102 via the controller cable 101. The sensor board 102 may control light emitting diodes (LEDs) (not shown) on the control panel 400 to allow the user to visually identify the current water temperature. According to another aspect, the LEDs may be defined on the sensor board 102. In still yet another aspect, the LEDs may be defined on the faucet 200.

According to an aspect, as illustrated in FIG. 4, one end of a hot water supply hose 175 may be connected to a hot water supply valve 155 and the other end of the hot water supply hose 175 may be connected to the hot water intake pipe 165. Similarly, one end of a cold water supply hose 176 may be connected to a cold water supply valve 156 and the other end of cold water supply hose 176 may be connected to the cold water intake pipe 166.

In yet another aspect, as illustrated in FIG. 4, a power adapter 109, such as a low voltage AC adapter, may supply power to both the control panel 400 and the control box 300. The control box 300 may supply the power received from the power adapter 109 to the mixing chamber 301. The power adapter 109 may be plugged into an electrical outlet 110. A battery box 309 may also be provided as a back-up power source. The battery box 309 may include a rechargeable battery that may receive power from the power adapter 109 and/or batteries, such as standard AA batteries, or a combination thereof.

Figure 5:
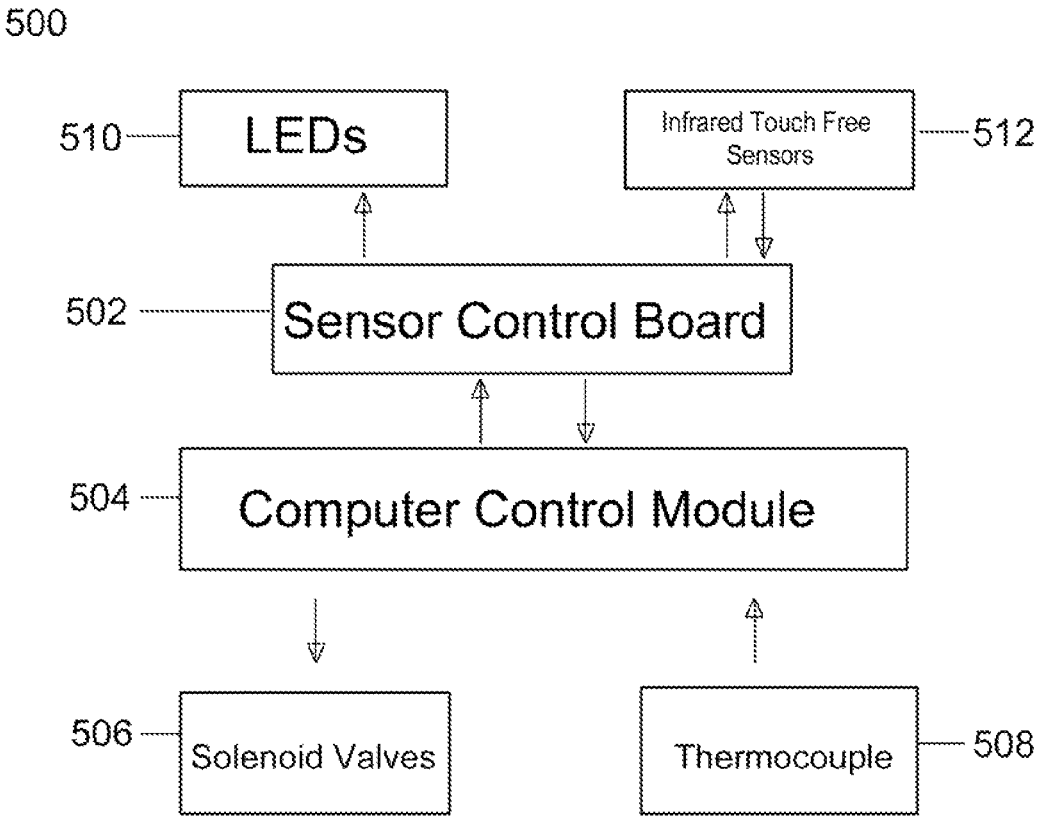
FIG. 5 illustrates the block diagram of a fluid control valve system according to an aspect of the present disclosure.

FIG. 5 illustrates a block diagram of a fluid control valve system according to an aspect of the present disclosure. As illustrated in FIG. 5, a fluid control valve system 500 may include a sensor control board 502, a computer control module 504, solenoid valves 506, a thermocouple 508, LEDs 510, and infra-red touch free sensors 512. According to this aspect, the infra-red touch free sensors 512 may receive a user input and transmit a signal to the sensor control board 502. The sensor control board 502 may process and transmit the signal to the computer control module 504. The computer control module 504 processes the received signal and controls the solenoid valves 506 to open and close to reach the desired water temperature according to the input received at the infra-red touch free sensors 512. The thermocouple 508 monitors the water temperature to determine when the desired temperature has been achieved. The thermocouple 508 may transmit a notification to the computer control module 504 when the user requested temperature has reached, and the computer control module 504 may notify the sensor control board 502 that the temperature has been reached. Finally, the sensor control board 502 may control the LEDs 510 to display a visual output based on the water temperature.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

What is claimed:

1. A method for regulating fluid output, the method comprising:

transmitting a signal to a control unit in response to receiving an input at one or more of a plurality of adjusting sensors when fluid is currently output from a fluid output unit, the plurality of adjusting sensors comprising a plurality of temperature sensors for controlling a temperature of fluid from a first temperature to a second temperature and a plurality of volume sensors for controlling a volume of fluid from a first volume to a second volume, the second volume being different from the first volume and the second temperature being different from the first temperature;

controlling, via the control unit, a plurality of first solenoid valves and a plurality of second solenoid valves coupled directly to a fluid mixing chamber for fluid communication, a plurality of first orifices and a plurality of second orifices being defined within the fluid mixing chamber, each of the plurality of first solenoid valves being substantially aligned with one of the plurality of first orifices and each of the plurality of second solenoid valves being substantially aligned with one of the plurality of second orifices;

creating a fluid mixture in the fluid mixing chamber based on the fluid communication from at least the plurality of first solenoid valves, the plurality of second solenoid valves, or a combination thereof; and outputting the fluid mixture from the fluid mixing chamber to the fluid output unit.

2. The method of claim 1, in which:

controlling the plurality of first solenoid valves comprises opening or closing each of the plurality of first solenoid valves to regulate a first fluid volume in the fluid mixing chamber; and controlling the plurality of second solenoid valves comprises opening or closing each of the plurality of second solenoid valves to regulate a second fluid volume in the fluid mixing chamber.

3. The method of claim 2, in which:

controlling the plurality of first solenoid valves comprises opening or closing each of the plurality of first solenoid valves based at least in part on a size of each of the plurality of first orifices substantially aligned with each of the plurality of first solenoid valves; and controlling the plurality of second solenoid valves comprises opening or closing each of the plurality of second solenoid valves based at least in part on a size of each of the plurality of second orifices substantially aligned with each of the plurality of second solenoid valves.

4. The method of claim 1, in which transmitting the signal comprises transmitting a first signal for increasing a fluid temperature, a second signal for decreasing the fluid temperature, a third signal for increasing a fluid pressure, and a fourth signal for decreasing the fluid pressure.

5. The method of claim 1, further comprising:

receiving a first fluid at the plurality of first solenoid valves via a a first fluid input unit; and receiving a second fluid at the plurality of second solenoid valves via a second fluid input unit.

6. The method of claim 1, in which the plurality of adjusting sensors are infra-red touch free sensors.

7. The method of claim 1, in which the fluid output unit is a faucet.

8. The method of claim 1, in which:

each of the plurality of first orifices is different in size; and each of the plurality of second orifices is different in size.

9. The method of claim 1, in which the plurality of first orifices are defined within a first surface of the fluid mixing chamber and the plurality of second orifices are defined within a second surface of the fluid mixing chamber.

10. The method of claim 9, in which the first surface is on a first plane of the fluid mixing chamber and that is opposite to a second plane of the fluid mixing chamber, the second surface being on the second plane.

11. A fluid regulating apparatus, comprising:

an input unit configured to receive a user input via at least one of a plurality of adjusting sensors when fluid is currently output from a fluid output unit, the plurality of adjusting sensors comprising a plurality of temperature sensors for controlling a temperature of fluid from a first temperature to a second temperature and a plurality of volume sensors for controlling a volume of fluid from a first volume to a second volume, the second volume being different from the first volume and the second temperature being different from the first temperature;

a control unit configured to transmit a signal in response to the user input; and a plurality of first solenoid valves and a plurality of second solenoid valves coupled directly to a fluid mixing chamber for fluid communication controlled via the signal, a plurality of first orifices and a plurality of second orifices being defined within the fluid mixing chamber, each of the plurality of first solenoid valves being substantially aligned with one of the plurality of first orifices and each of the plurality of second solenoid valves being substantially aligned with one of the plurality of second orifices, the fluid mixing chamber being configured to:

store a fluid mixture based on the fluid communication from at least the plurality of first solenoid valves, the plurality of second solenoid valves, or a combination thereof; and output the fluid mixture to the fluid output unit.

12. The apparatus of claim 11, in which:

each of the plurality of first orifices is different in size; and each of the plurality of second orifices is different in size.

13. The apparatus of claim 11, in which the signal comprises at least a first signal for increasing a fluid temperature, a second signal for decreasing the fluid temperature, a third signal for increasing a fluid pressure, or a fourth signal for decreasing the fluid pressure.

14. The apparatus of claim 11, in which:

the plurality of first solenoid valves are connected to a first fluid input unit; and the plurality of second solenoid valves are connected to a second fluid input unit.

15. The apparatus of claim 11, in which the plurality of adjusting sensors are infra-red touch free sensors.

16. The apparatus of claim 11, in which the fluid output unit is a faucet.

17. The apparatus of claim 11, in which the plurality of first orifices are defined within a first surface of the fluid mixing chamber and the plurality of second orifices are defined within a second surface of the fluid mixing chamber.

18. The apparatus of claim 17, in which the first surface is on a first plane of the fluid mixing chamber and that is opposite to a second plane of the fluid mixing chamber, the second surface being on the second plane.

* * * * *